US010049678B2

(12) United States Patent
Nesta et al.

(10) Patent No.: US 10,049,678 B2
(45) Date of Patent: Aug. 14, 2018

(54) SYSTEM AND METHOD FOR SUPPRESSING TRANSIENT NOISE IN A MULTICHANNEL SYSTEM

(71) Applicant: SYNAPTICS INCORPORATED, San Jose, CA (US)

(72) Inventors: Francesco Nesta, San Jose, CA (US); Trausti Thormundsson, San Jose, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 15/088,073

(22) Filed: Mar. 31, 2016

(65) Prior Publication Data

US 2017/0206908 A1 Jul. 20, 2017

Related U.S. Application Data

(60) Provisional application No. 62/278,954, filed on Jan. 14, 2016.

(51) Int. Cl.

| | |
|---|---|
| ***G10L 19/00*** | (2013.01) |
| ***G10L 21/00*** | (2013.01) |
| ***G10L 19/025*** | (2013.01) |
| ***G10L 19/26*** | (2013.01) |
| ***G10L 19/008*** | (2013.01) |

(52) U.S. Cl.

CPC ..... *G10L 19/025* (2013.01); *G10L 19/008* (2013.01); *G10L 19/26* (2013.01)

(58) Field of Classification Search

None

See application file for complete search history.

(56) References Cited

U.S. PATENT DOCUMENTS

| | | | | |
|---|---|---|---|---|
| 7,539,612 | B2 * | 5/2009 | Thumpudi | G10L 19/035 704/200.1 |
| 7,885,420 | B2 * | 2/2011 | Hetherington | G10L 21/0208 381/94.2 |
| 7,885,819 | B2 * | 2/2011 | Koishida | G10L 19/167 704/500 |
| 8,538,749 | B2 * | 9/2013 | Visser | G10L 19/00 704/200 |
| 2010/0017205 | A1 * | 1/2010 | Visser | G10L 19/00 704/225 |
| 2016/0012828 | A1 * | 1/2016 | Chatlani | G10L 21/0232 704/205 |

* cited by examiner

*Primary Examiner* — Marcus T Riley

(74) *Attorney, Agent, or Firm* — Haynes and Boone, LLP

(57) ABSTRACT

Methods for processing a multichannel audio signal that includes transient noise signals are provided. The method includes buffering the multichannel audio signal in a subband domain, and estimating the subband frames for transient noise likelihood. A probability of transient noise for the buffered subband frames is determined and a multichannel spatial filter is applied to decompose the subband frames to transient attenuated target source and noise estimation cancelled of the target source signal. A spectral filter is applied to the target source frame to enhance the target source frame and the subband frames that are determined to have a probability of the transient noise greater than a first threshold and a probability of target source less than a second threshold are muted.

16 Claims, 4 Drawing Sheets

SYSTEM AND METHOD FOR SUPPRESSING TRANSIENT NOISE IN A MULTICHANNEL SYSTEM

CROSS-REFERENCE TO RELATED APPLICATIONS

This application claims the benefit of U.S. Provisional Application No. 62/278,954, filed Jan. 14, 2016; and is related to U.S. patent application Ser. No. 14/507,662 filed Oct. 6, 2014; U.S. patent application Ser. No. 14/809,137 filed Jul. 24, 2015; and U.S. patent application Ser. No. 14/809,134 filed Jul. 24, 2015; each of which is incorporated herein by reference in its entirety.

TECHNICAL FIELD

The present invention relates generally to audio noise suppression and, more particularly, to suppressing transient noise in a multichannel system.

BACKGROUND

Quality of Voice over IP (VoIP) calls and the performance of automatic speech recognition may be sensibly degraded by the presence of background noise. To overcome these problems, many speech enhancement techniques have been proposed. In some traditional single channel methods, the statistic of noise spectral power is estimated when the speech is silent, and then a spectral gain is determined from the noisy mixture. Some multichannel methods aim at reducing the noise by estimating spatial filters constrained to the speech and noise spatial covariance. While traditional single channel methods are effective in reducing stationary background noise, multichannel methods can remove more effectively non-stationary noise that is spatially coherent and spatially static. However, when the noise is both incoherent and non-stationary, neither of these methods is able to suppress it effectively.

An example of a noise that may be neither stationary nor spatially static is transient noise. Transient noise may vary more quickly than speech and its power is difficult to accurately estimate. Keyboard stroke noise and finger tap noise are examples of transient noise generated in mobile devices such as laptops or tablets. In these devices transient noise suppression may be utilized to improve the VoIP call quality.

Some methods for transient noise suppression are based on ad-hoc spectral models aimed at the detection of the transient frames. However, because the transient noise power is not deterministically predictable, spectral gains derived by these models are more prone to distort the speech. This happens more frequently with unvoiced speech frames since they have a transient-like characteristic.

Various techniques for reducing transient noise or keystroke suppression, mostly based on single channel processing, are identified in: U.S. Patent Application Publication No. 2008/0212795, published on Sep. 4, 2008 and entitled "Transient Detection and Modification in Audio Signals"; U.S. Pat. No. 8,213,635 issued on Jul. 3, 2012 and "Keystroke Sound Suppression"; Min-Seok Choi and Hong-Goo Kang, "Transient Noise Reduction In Speech Signal With a Modified Long-Term Predictor," in EURASIP Journal on Advances in Signal Processing, December 2011; and R. Talmon, I. Cohen, S. Gannot, "Single-Channel Transient Interference Suppression With Diffusion Maps" in IEEE Transactions on Audio, Speech, and Language Processing, Vol. 21, No. 1, January 2013. However, the techniques described in these references are subject to speech distortion because speech onset can have a spectral characteristic that is very close to that of the noise. Although a multichannel technique is identified in U.S. Pat. No. 8,867,757 issued on Oct. 21, 2013 "Microphone Under Keyboard to Assist In Noise Cancellation," it requires an ad-hoc microphone placement which can limit its flexibility for general purpose consumer applications.

SUMMARY

In accordance with embodiments set forth herein, various techniques are provided to reduce or suppress noise, and in particular, transient noise in a multichannel audio system.

According to an embodiment of the disclosure, a method for processing a multichannel audio signal including transient noise signals is provided. The method may include: transforming, by a subband decomposition subsystem, the multichannel signal from time-domain to subband frames in subband domain; buffering, by a delay subsystem, the subband frames to estimate a transient noise likelihood for each of the subband frames; determining, by a detecting subsystem, probability of transient noise for the buffered subband frames based on the estimated noise likelihood; applying, by a spatial decomposition subsystem, a multichannel spatial filter to decompose the subband frames to transient attenuated target source and noise estimation cancelled of the target source signal; applying, by a spectral post-filtering subsystem, a spectral filter to the target source frame to enhance the target source frame; suppressing, by a residual noise gating subsystem, the subband frames determined to comprise a probability of the transient noise greater than a first threshold and a probability of target source less than a second threshold; reconstructing, by a subband synthesis system, the subband frames to processed time-domain signals.

According to another embodiment of the disclosure, a computer system is provided. The system may include: a processor; and a memory, wherein the memory has stored thereon instructions that, when executed by the processor, causes the processor to: transform, by a subband decomposition subsystem, the multichannel signal from time-domain to subband frames in subband domain; buffer, by a delay subsystem, the subband frames to estimate a transient noise likelihood for each of the subband frames; determine, by a detecting subsystem, probability of transient noise for the buffered subband frames based on the estimated noise likelihood; apply, by a spatial decomposition subsystem, a multichannel spatial filter to decompose the subband frames to transient attenuated target source and noise estimation cancelled of the target source signal; apply, by a spectral post-filtering subsystem, a spectral filter to the target source frame to enhance the target source frame; suppress, by a residual noise gating subsystem, the subband frames determined to comprise a probability of the transient noise greater than a first threshold and a probability of target source less than a second threshold; reconstruct, by a subband synthesis system, the subband frames to processed time-domain signals.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

In accordance with various embodiments, systems and methods are provided for suppressing transient noise in multichannel audio signals. As further discussed herein, such systems and methods may be implemented by one or more systems which may include, in some embodiments, one or more subsystems (e.g., modules to perform task-specific processing) and related components thereof.

According to an embodiment of the disclosure, a multichannel supervised blind source separation approach is utilized to jointly estimate spatial filters (e.g., an approximation of the spatial filters) that are able to segregate the mixture in a partially transient noise cancelled signal and a target (e.g., speech) cancelled signal. This estimation is supervised by a transient noise detector that determines the frames with high probability of transient and low probability of speech. The actual filtering may then be carried out by using the spatially enhanced outputs to generate multichannel spectral gains. The above described configuration allows for performing filtering criteria, which may be related to the spatial characteristic of the target source and of the noise, without explicitly using a spectral model for the transient noise nor for the target source (e.g., speech). Furthermore, in some embodiments, because the target source of interest (e.g., speaker) is a coherent and static source in the space, a spatially-driven suppression may be possible even if the transient noise does not come from static spatial locations.

Figure 1:
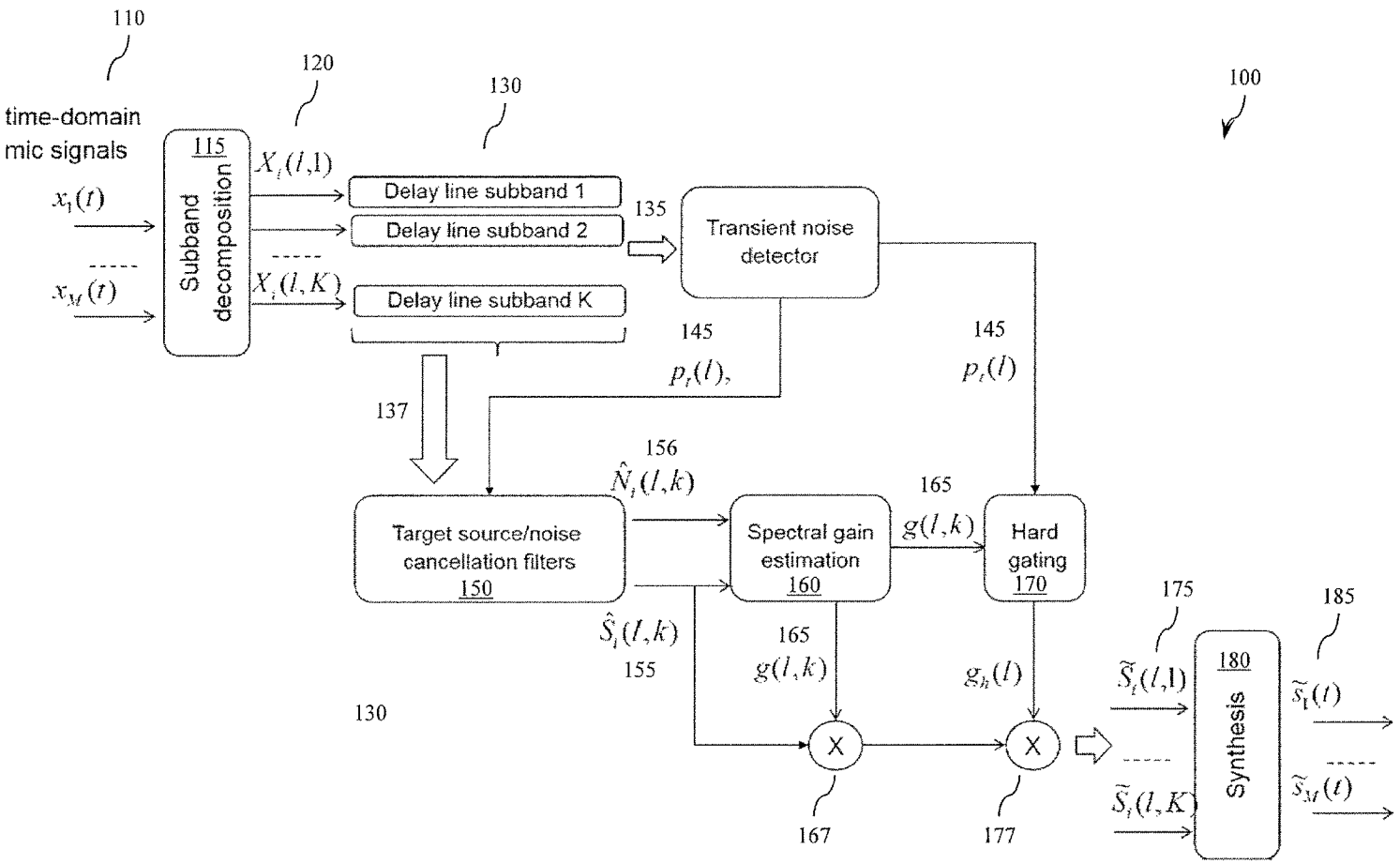
FIG. 1 is a block diagram of an audio processing system for suppressing transient noise, according to an embodiment of the disclosure.

According to an embodiment, FIG. 1 illustrates a diagram of an audio processing system 100 for suppressing transient noise. The system 100 may include a subband analysis module 115 coupled with a number of input audio signal sources such as microphones to receive audio signals in the time-domain. The subband analysis module 115 may transform the time-domain signals 110 to subband frames 120. The output of the subband analysis module 115 may be provided to delay lines 130 for each subband, and the delayed (e.g., buffered) subband frames 135 are provided to a microphone channel transient noise detector 140.

According to an embodiment, the microphone channel transient noise detector 140 determines a likelihood measure of peakedness (e.g., based on wide spectral peakedness) from the delayed (e.g., buffered) subband frames 135. The determined likelihood (e.g., probability 145) is provided to the target source/noise cancellation filter module 150 where the probability 145 is utilized by the target source/noise cancellation filters to decompose the subband frames 137 (that are provided to the target source/noise cancellation filter module 150) to a target speech component 155 and a noise component 156. The target speech component 155 and the noise component 156 are both provided to the spectral gain estimation module 160, and the target speech component 155 is also provided to module 167. The spectral gain estimation module 160 computes an estimated spectral gain 165, and provides the estimated spectral gain 165 to module 167, where the gain is utilized to enhance the target speech component 155. The estimated spectral gain 165 is also provided to a hard gating module 170. In some embodiments, the hard gating module 170 also receives the probability 145 from the transient noise detector 140, and utilizes both the probability 145 and the estimated spectral gain 165 to determine whether or not to suppress residual transient noise at module 177. Finally, the system 100 may include a synthesis module 180 for transforming the enhanced subband signals 175 (e.g., frames) based on the decomposition by the target source/noise cancellation filter module 150, spectral gain estimator 160, and the hard gating module 170, to time-domain signals 185.

In further detail as illustrated in FIG. 1, the multichannel time-domain microphone signals $x_i(t)$ 110 (with i being the channel index) are first transformed to a subband domain as $X_i(l,k)$ 120 by the subband analysis module 115, where k is the subband index and l is the downsampled time frame index. For each subband, the last L frames are stored in a linear buffer 130, for example, according to equation (1) below:

$$B_i^k(l)=[X_i(l-L+1,k), \ldots, X_i(l,k)]; \tag{1}$$

In some embodiments, the subband frames 137 are provided to the target source/noise cancellation filter module 150, and the buffered subband frames 135 are provided to the transient noise detector subsystem 140. In some embodiments, a likelihood measure of peakedness is computed by the transient noise detector subsystem 140 from the buffered subband frames 135. By way of example, a likelihood measuring the degree of transient noise may be computed as:

$$f_i^k(l) = \text{median}[|B|_i^k(l)] \tag{2}$$

$$m_i^k(l) = \max[|B|_i^k(l)] \tag{3}$$

$$T(l) = \max_i \frac{1}{K} \sum_k \frac{|m_i^k(l) - f_i^k(l)|}{m_i^k(l)} \tag{4}$$

where $|B|_i^k(l)$ indicates the magnitude of the elements in the buffer at subband k and channel i. The likelihood T(l) is then mapped to a probability of transient noise by using any statistical classification model. For example, by neglecting the index frame l for simplicity and by using a naïve Bayesian classifier, the posterior probability for the transient class may be computed as:

$$p_t(l) = \frac{p(t)p(T(l)|t)}{p(s)p(T(l)|s) + p(t)p(T(l)|t)} \tag{5}$$

where p(T(l)|t) and p(T(l)|s) are the probability density functions (likelihoods) of T(l) for the transient noise and target source classes, while p(t) and p(s) are class priors. The parameters of this model are estimated with oracle training data by recording the target source (e.g., speech) and transient noise separately. According to the wanted physical meaning of $p_t(l)$, training data might also include conditions were the target source (e.g. speech) and transient noise are present simultaneously. As an example of a parametric model, a Gaussian Mixture Model (GMM) may be employed according to one embodiment. Accordingly, a target speech multichannel cancellation filter and a noise multichannel cancellation filter may be jointly updated based on the probability $p_t(l)$. The updated target speech multichannel cancellation filter and a noise multichannel cancellation filter may then utilize the updated filters to decompose the subband frames 137 into a target speech component 155 and a noise component 156, which will be provided in more detail later. The decomposed target speech component 155 and noise component 156 are provided to the spectral gain estimator 160 to compute the estimated spectral gain 165. Additionally, the target speech component 155 is combined with the estimated spectral gain 165 at module 167. The estimated spectral gain 165 is also provided to the hard gating module 170, and the hard gating module 170 together with the probability $p_t(l)$ 145 determines whether or not to apply hard gating to hardly mute the output signal of the corresponding frames at module 177. This enhanced subband domain signal 175 is provided to the synthesis module 180 to transform the enhanced subband domain signals 175 to time-domain signals 185.

Figure 2:
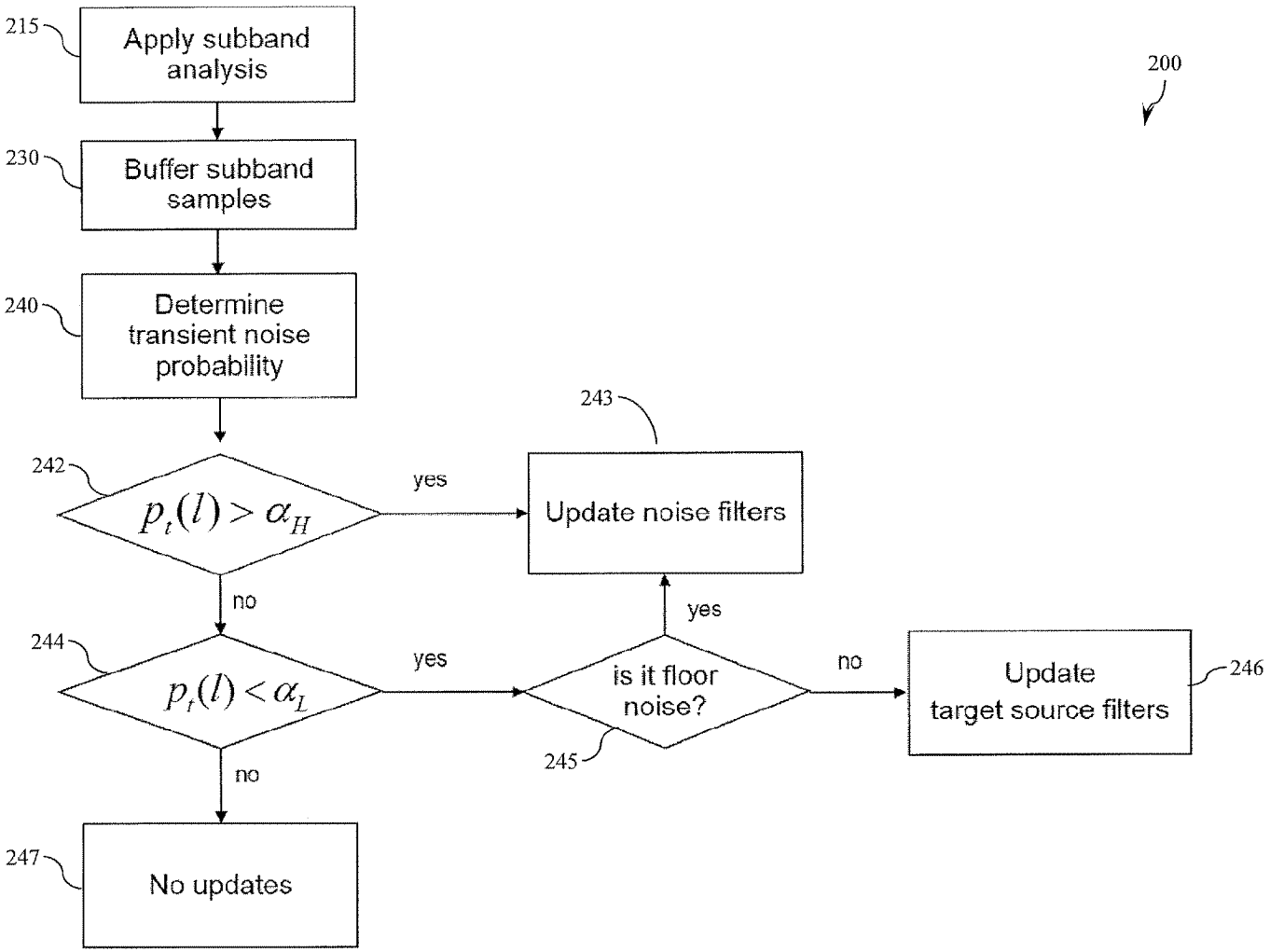
FIG. 2 is a flow diagram of a process for updating adaptive filters of FIG. 1, according to an embodiment of the disclosure.

FIG. 2 illustrates a flow diagram 200 of a process for updating the target speech multichannel cancellation filter and a noise multichannel cancellation filter at the target source/noise cancellation filter module 150 shown in FIG. 1. As described above, a subband analysis is applied (215) to the time-domain multichannel signals (110 in FIG. 1) to transform the signals into subband frames (120 in FIG. 1). The transformed subband frames are buffered (230) by the buffers (e.g., delay lines) (130 in FIG. 1), and the probability of transient noise in the buffered subband frames is determined (240). The probability $p_t(l)$ is compared against thresholds $\alpha_H$ and $\alpha_L$. If the probability $p_t(l)$ is greater than $\alpha_H$ (242), then the noise filters are updated (243). If the probability $p_t(l)$ is not greater than $\alpha_H$ (242), then the probability $p_t(l)$ is compared against a threshold $\alpha_L$ (244). If the probability $p_t(l)$ is less than $\alpha_L$ (244), then it determines that floor noise (245) is present. If the floor noise is present, then the noise filters are updated (243). Otherwise, if the floor noise is not present, then the target source filters are updated (246). If the probability $p_t(l)$ is not less than $\alpha_L$ (244), then none of the filters are updated (247).

Spatial decomposition in target source and noise signals will now be provided. In some embodiments, the multichannel cancellation filters are computed through a weighted Natural Gradient adaptation (e.g., in accordance with techniques set forth in F. Nesta and M. Omologo, "Convolutive Underdetermined Sources Separation Through Weighted Interleaved ICA and Spatio-temporal Correlation," in Proceeding of LVA/ICA, March 2012, which is incorporated herein by reference in its entirety), which is able to decompose the signal mixtures in target source and noise components (155 and 156 in FIG. 1) according to the likelihood of transient noise dominance. An efficient subband on-line implementation for the cancellation filters learning may be utilized, as described in, for example, in U.S. patent application Ser. No. 14/507,662 filed Oct. 6, 2014 (published as U.S. Patent Application Publication No. 2015/0117649 on Apr. 30, 2015), which is incorporated herein by reference in its entirety. In some embodiments, the basic structure of the adaptive spatial decomposition learning may be provided as follows.

For each subband k, starting from the current initial M×M demixing matrix R(l,k), Y(l,k) may be calculated as:

$$Y(l,k)=\begin{bmatrix} Y_1(l,k) \\ \dots \\ Y_M(l,k) \end{bmatrix}=R(l,k)\begin{bmatrix} X_1(l,k) \\ \dots \\ X_M(l,k) \end{bmatrix} \tag{6}$$

Let $Z_i(l,k)$ be the normalized $Y_i(l,k)$, which may be calculated as:

$$Z_i(l,k)=Y_i(l,k)/|Y_i(l,k)| \tag{7}$$

Let $Y_i(l,k)^*$ be the conjugate of $Y_i(l,k)$. Then, a generalized covariant matrix may be formed as:

$$C(l,k)=\begin{bmatrix} Z_1(l,k) \\ \dots \\ Z_M(l,k) \end{bmatrix}[Y_1(l,k)^* \ \dots \ Y_M(l,k)^*] \tag{8}$$

Weights may be defined as:

$$w_1=1, \text{ if } p_t(l)<\alpha_l \text{ (0 otherwise)} \tag{9}$$

$$w_i=1, \text{ if } p_t(l)>\alpha_h \text{ (0 otherwise)}, \forall i \tag{10}$$

$$a=1, \text{ if } \frac{1}{M}\sum_i |X_i(l,k)|^2>\beta E[|B(k)|^2] \text{ (0 otherwise)} \tag{11}$$

where E[|B(k)|] is the expectation of the background noise power, which may be computed as a smooth recursive time-average of $|X_i(l,k)|$ and β is an overestimation parameter with values ≥1. The weighting matrix may be defined as:

$$W(l)=\begin{bmatrix} \eta w_1 a & 0 & 0 & 0 \\ 0 & \eta w_2 \| (1-a) & 0 & 0 \\ 0 & 0 & \dots & 0 \\ 0 & 0 & 0 & \eta w_M \| (1-a) \end{bmatrix} \tag{12}$$

where || is the logic "or" operator and η is a step-size parameter that controls the speed of the adaptation. Then, the matrix Q(l,k) may be computed as:

$$Q(l,k)=I-W(l)+S(l,k)\cdot C(l,k)W(l) \tag{13}$$

Finally, the rotation matrix may be updated as:

$$R(l+1,k)=S(l,k)\cdot Q(l,k)^{-1}R(l,k) \tag{14}$$

where $Q(l,k)^{-1}$ is the inverse matrix of Q(l,k) and S(l,k) is a normalizing scaling factor computed as $S(l,k)=1/\|C(l,k)\|_\infty$ ($\|\cdot\|_\infty$ indicates the Chebyshev norm, i.e., the maximum absolute value in the elements of the matrix). Given the estimated rotation matrix R(l,k), the Minimal Distortion Principle (MDP) (e.g., in accordance with techniques set forth in K. Matsuoka and S. Nakashima, "Minimal Distortion Principle for Blind Source Separation," in Proceedings of International Symposium on ICA and Blind Signal Separation, San Diego, Calif., USA, December 2001, which is incorporated herein by reference in its entirety) may be utilized to compute the multichannel image of the s-th source signal (with s=1, . . . , M) as:

$$Y^s(l,k)=H^s(l,k)R(l,k)X(l,k) \tag{15}$$

where $H^s(l,k)$ is the matrix obtained by computing the inverse of R(l,k) and setting to zero all the elements except for those in the s-th column. Because of the structure of the weighting matrix W(l), the component $Y^1(l,k)$ corresponds to the estimation of the target source, while the remaining components for s=2, . . . , M, correspond to the residual background or transient noise (e.g., in accordance with techniques set forth in F. Nesta and M. Matassoni, "Blind Source Extraction for Robust Speech Recognition in Multisource Noisy Environments," Comput. Speech Lang., Vol. 27, No. 3, pp. 703-725, May 2013, which is incorporated herein by reference in its entirety).

Spectral filtering according to various embodiments will now be provided. Once the mixture signal is decomposed to the estimated target source and noise components 155 and 156 by the target source cancellation filters and the noise cancellation filter module 150, any spectral filtering can be applied by the spectral gain estimation 160, which may be formulated as a function of the estimated target source power and residual noise power.

$$g_i(l,k)=f\left(|Y_i^1(l,k)|,\sum_{s=2}^{M}|Y_i^s(l,k)|\right) \tag{16}$$

For example, a Wiener-like spectral gain may be computed as:

$$g_i(l,k)=\sqrt[1/\gamma]{\frac{|Y_i^1(l,k)|^\gamma}{|Y_i^1(l,k)|^\gamma+\alpha\sum_{s=2}^{M}|Y_i^s(l,k)|^\gamma}} \tag{17}$$

where $\gamma$ and $\alpha$ are filtering parameters, which may be tuned with training test data to maximize specific objective performance metrics. While this function may provide a degree of enhancement, more sophisticated adaptive spectral filtering methods may be utilized, such as, for example, based on the statistical property of the difference of the output signal magnitudes $|Y_i^s(l,k)|$ as described in U.S. patent application Ser. No. 14/809,137 filed Jul. 24, 2015, which is incorporated herein by reference in its entirety. Although speech is provided as an example target source signal, as in many audio applications, the embodiments of the present disclosure are not limited thereto. Instead, the target source signal may be other non-stationary non-transient-ness sources.

Figure 3:
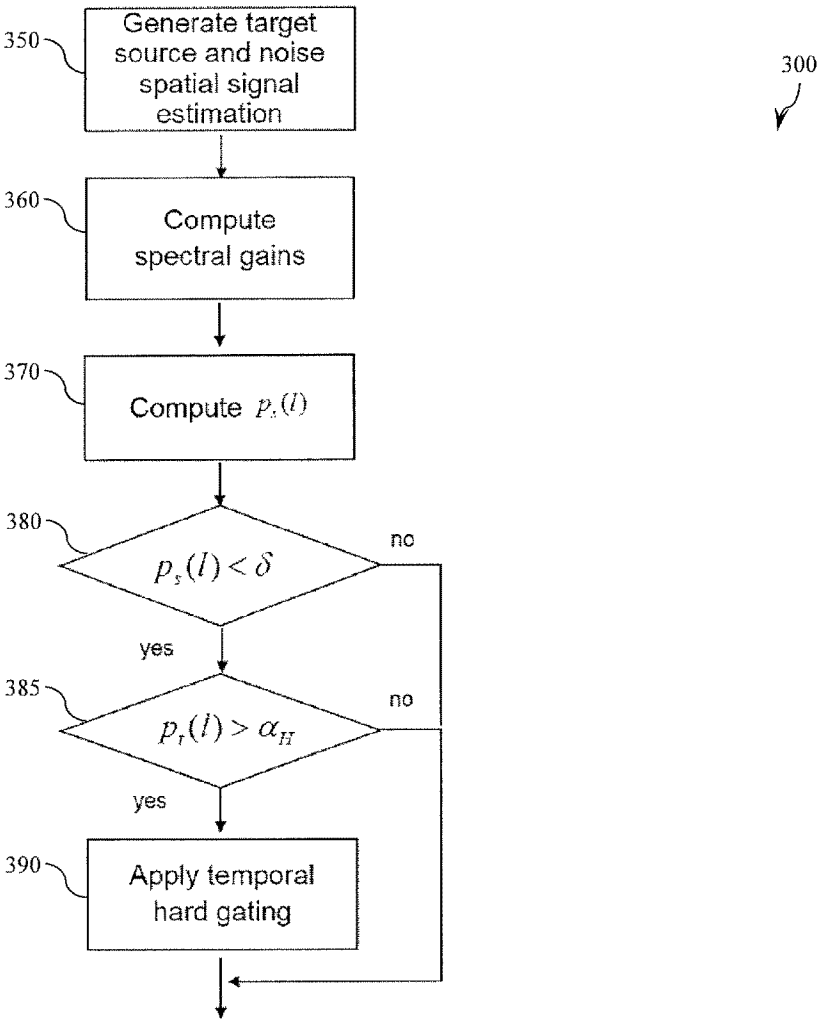
FIG. 3 is a flow diagram of a process for suppressing residual transient noise, according to an embodiment of the disclosure.

Echo temporal gating for suppressing residual transient noise by the hard gating module 170 (see FIG. 1) will now be provided according to an embodiment as illustrated in the process shown in FIG. 3. In some embodiments, the transient and background noise from the target source signal may be spatially suppressed, even during target source (e.g., speech) activity. However, residual transient noise may still be audible due to its high non-stationary characteristics. Thus, in some embodiments, the output signals that correspond to the transient noise localized in frames where the target source is absent or substantially absent, may be hardly muted to 0. For example, the condition $p_t(l)>\alpha_h$ may be utilized as a hard detector for the transient noise presence. However, in frames with low speech, this condition may still be satisfied, leading to a detrimental cancellation of speech frames. Thus, the probability $p_t(l)$ may be complemented with a separate pseudo-probability of output target source presence by exploiting the spatial diversity between the target source and the noise. Target source and noise spatial signal is estimated (350). From the spectral gains estimated (360) from the output of the spatial filters, the likelihood $p_s(l)$ (370) may be computed as:

$$p_s(l)=\frac{\sum_i\sum_k|X_i(l,k)|g_i(l,k)}{\sum_i\sum_k|X_i(l,k)|} \tag{18}$$

which is a measure of the attenuation produced by the filtering for a particular frame. Indirectly, $p_s(l)$ measures the degree of correlation of a particular input frame to the direction spanned by the target source cancellation filters. The l-th frame is then muted by applying hard temporal gating (390) if the following two conditions are met: a) $p_t(l)>\alpha_h$ (380), and b) $p_s(l)<\delta$ (385). The second condition mitigates the effect of false alarms in the transient noise detection when the target source signal overlaps the transient noise. The threshold can be fixed by imposing the expected minimum signal-to-noise ratio (SNR) (in linear scale) between target source and noise.

Accordingly, the embodiments described herein provide a framework that may be adopted with any number of microphones, and are able to reduce transient noise during target source activity with limited distortion to the signal. The techniques are based on a general spectral definition of "transient," and then used for a variety of impulsive noise signals such as, keyboard clicks, screen tap noise, clap noise, microphone tapping, etc. It is able to precisely hardly mute any transient noise during target source pauses with a relatively low risk of muting the source signal, and it does not make any specific assumption on the target signal other than it being a non-stationary non-transient-ness source. Therefore, the provided techniques may be used to enhance speech signals with low artifacts independently if the speech is voiced or unvoiced. While the spectral diversity is used for the target source/transient noise classification and detection, the filtering is driven by the spatial diversity between the transient and the target source. Consequently, filtering artifacts and residual noise are evenly distributed in the spectrum. Furthermore, to prevent or further reduce speech distortion, the filtering approach should not solely rely on the spectral transient noise model.

Figure 4:
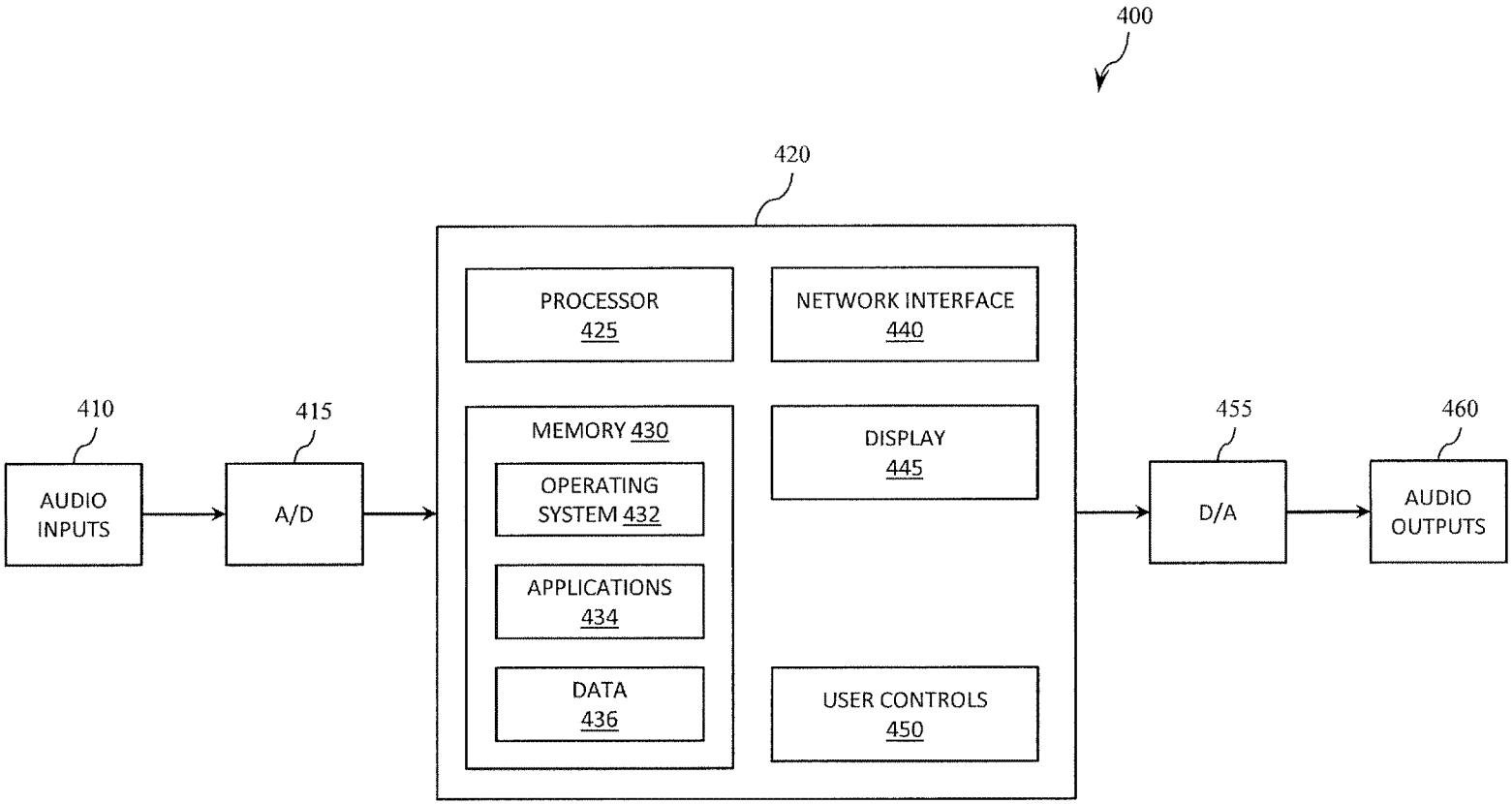
FIG. 4 is a block diagram of an example hardware system, according to an embodiment of the disclosure.

As discussed, the various techniques provided herein may be implemented by one or more systems which may include, in some embodiments, one or more subsystems and related components thereof. For example, FIG. 4 illustrates a block diagram of an example hardware system 400 in accordance with an embodiment of the disclosure. In this regard, system 400 may be used to implement any desired combination of the various blocks, processing, and operations described herein (e.g., system 100, process 200, and process 300). Although a variety of components are illustrated in FIG. 4, components may be added and/or omitted for different types of devices as appropriate in various embodiments.

As shown, system 400 includes one or more audio inputs 410 which may include, for example, an array of spatially distributed microphones configured to receive sound from an environment of interest. Analog audio input signals provided by audio inputs 410 are converted to digital audio input signals by one or more analog-to-digital (A/D) converters 415. The digital audio input signals provided by A/D converters 415 are received by a processing system 420.

As shown, processing system 420 includes a processor 425, a memory 430, a network interface 440, a display 445, and user controls 450. Processor 425 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), codecs, and/or other processing devices.

In some embodiments, processor 425 may execute machine readable instructions (e.g., software, firmware, or other instructions) stored in memory 430. In this regard, processor 425 may perform any of the various operations, processes, and techniques described herein. For example, in some embodiments, the various processes and subsystems described herein (e.g., system 100, process 200, and process 300) may be effectively implemented by processor 425 executing appropriate instructions. In other embodiments, processor 425 may be replaced and/or supplemented with dedicated hardware components to perform any desired combination of the various techniques described herein.

Memory 430 may be implemented as a machine readable medium storing various machine readable instructions and data. For example, in some embodiments, memory 430 may store an operating system 432 and one or more applications 434 as machine readable instructions that may be read and executed by processor 425 to perform the various techniques described herein. Memory 430 may also store data 436 used by operating system 432 and/or applications 434. In some embodiments, memory 420 may be implemented as non-volatile memory (e.g., flash memory, hard drive, solid state drive, or other non-transitory machine readable mediums), volatile memory, or combinations thereof.

Network interface 440 may be implemented as one or more wired network interfaces (e.g., Ethernet, and/or others) and/or wireless interfaces (e.g., WiFi, Bluetooth, cellular, infrared, radio, and/or others) for communication over appropriate networks. For example, in some embodiments, the various techniques described herein may be performed in a distributed manner with multiple processing systems 420.

Display 445 presents information to the user of system 400. In various embodiments, display 445 may be implemented as a liquid crystal display (LCD), an organic light emitting diode (OLED) display, and/or any other appropriate display. User controls 450 receive user input to operate system 400 (e.g., to provide user defined parameters as discussed and/or to select operations performed by system 400). In various embodiments, user controls 450 may be implemented as one or more physical buttons, keyboards, levers, joysticks, and/or other controls. In some embodiments, user controls 450 may be integrated with display 445 as a touchscreen.

Processing system 420 provides digital audio output signals that are converted to analog audio output signals by one or more digital-to-analog (D/A) converters 455. The analog audio output signals are provided to one or more audio output devices 460 such as, for example, one or more speakers.

Thus, system 400 may be used to process audio signals in accordance with the various techniques described herein to provide improved output audio signals with improved speech recognition.

In view of the above and according to an embodiment, a method for processing multichannel audio signals and producing a transient noise cancelled enhanced output signal may be provided. The method may include a subband analysis transforming time-domain signals to under-sampled K subband signals, a buffer for saving a certain amount of spectral frames in order to estimate the transientness likelihood for a particular frame, a subsystem for determining the probability of transient noise presence or for classifying each frame in a transient noise or target source signal, a multichannel spatial filter decomposing the mixtures in signal components representing the transient attenuated target source signal and the noise estimation cancelled of the target source signal, a spectral postfilter exploiting the multichannel signal estimation resulting from the spatial filter decomposition and producing spectral gains to enhance the target source, a hard transient noise gating estimating the probability of the target source presence, and muting the frames with high probability of transient-noise and low probability of target source. A subband may be synthesized to reconstruct subband signals to time-domain.

In a further embodiment, the method may include a block computing a transient likelihood feature based on a relative difference between median and maximum spectral statistic, and a statistical based Bayesian classifier (e.g. employing a parametric Gaussian Mixture Model (GMM)) pre-trained on target and transient noise source frames generating a probability of transient noise from the transient likelihood.

In some embodiments, the method may further include a supervised multichannel blind demixing based on Independent Component Analysis.

In some embodiments, the method may further include an efficient on-line weighted Natural Gradient, and a weighting matrix inducing the demixing system to separate the target source signal from the transient and background noise signals.

Where appropriate, one or more embodiments of the present disclosure may be implemented with one or more of the embodiments set forth in: U.S. patent application Ser. No. 14/507,662 filed Oct. 6, 2014 (published as U.S. Patent Application Publication No. 2015/0117649 on Apr. 30, 2015); U.S. patent application Ser. No. 14/809,137 filed Jul. 24, 2015; and U.S. patent application Ser. No. 14/809,134 filed Jul. 24, 2015, all of which are incorporated herein by reference in their entirety.

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa. Embodiments described above illustrate but do not limit the invention. It should also be understood that numerous modifications and variations are possible in accordance with the principles of the present invention. Accordingly, the scope of the invention is defined only by the following claims and their equivalents.

What is claimed is:

1. A method for processing a multichannel audio signal comprising transient noise signals, the method comprising:

transforming, by a subband decomposition subsystem, the multichannel audio signal from time-domain to subband frames in subband domain;

buffering, by a delay subsystem, the subband frames to estimate a transient noise likelihood for each of the subband frames;

determining, by a detecting subsystem, probability of transient noise for the buffered subband frames based on the estimated transient noise likelihood;

applying, by a spatial decomposition subsystem, a multichannel spatial filter to decompose the subband frames to signal components comprising a transient attenuated target source signal and a noise estimation cancelled of the transient attenuated target source signal, wherein the multichannel spatial filter is adaptively updated based on the probability of transient noise;

applying, by a spectral post-filtering subsystem, a spectral filter to the subband frames of the transient attentuated target source signal to enhance the transient attenuated target source signal;

suppressing, by a residual noise gating subsystem, residual transient noise in the enhanced transient attenuated target source signal by muting the subband frames determined to comprise a probability of the transient noise greater than a first threshold and a probability of target source less than a second threshold; and reconstructing, by a subband synthesis system, the subband frames of the enhanced transient attenuated target source signal to processed time-domain signals.

2. The method of claim 1, wherein the multichannel spatial filter comprises noise filters and target source filters, the method further comprising updating the noise filters in response to the probability of transient noise meeting a set criteria.

3. The method of claim 1, wherein the estimating the transient noise likelihood comprises computing a relative difference between median and maximum spectral statistic.

4. The method of claim 1, wherein the determining the probability transient noise for the buffered subband frames comprises a model based Bayesian classifier including a Gaussian Mixture Model.

5. The method of claim 1, wherein the decomposing of the subband frames comprises performing a supervised multichannel blind demixing based on independent component analysis.

6. The method of claim 1, wherein the suppressing of the subband frames comprises performing a weighted Natural Gradient adaptation.

7. The method of claim 1, wherein each channel of the multichannel audio signal is provided by a microphone.

8. The method of claim 1, wherein the multichannel audio signal comprises static noise signals and target audio signals.

9. A computer system comprising:

a processor; and a memory, wherein the memory has stored thereon instructions that, when executed by the processor, causes the processor to:

transform, by a subband decomposition subsystem, a multichannel audio signal from time-domain to subband frames in subband domain;

buffer, by a delay subsystem, the subband frames to estimate a transient noise likelihood for each of the subband frames;

determine, by a detecting subsystem, probability of transient noise for the buffered subband frames based on the estimated transient noise likelihood;

apply, by a spatial decomposition subsystem, a multichannel spatial filter to decompose the subband frames to signal components comprising a transient attenuated target source signal and a noise estimation cancelled of the transient attenuated target source signal, wherein the multichannel spatial filter is adaptively updated based on the probability of transient noise;

apply, by a spectral post-filtering subsystem, a spectral filter to the subband frames of the transient attenuated target source signal to enhance the transient attenuated target source signal;

suppress, by a residual noise gating subsystem, residual transient noise in the enhanced transient attenuated target source signal by muting the subband frames determined to comprise a probability of the transient noise greater than a first threshold and a probability of target source less than a second threshold; and reconstruct, by a subband synthesis system, the subband frames of the enhanced transient attenuated target source signal to processed time-domain signals.

10. The system of claim 9, wherein the multichannel spatial filter comprises noise filters and target source filters, the processor being further configured to update the noise filters in response to the probability of transient noise meeting a set criteria.

11. The system of claim 9, wherein the estimating the transient noise likelihood comprises computing a relative difference between median and maximum spectral statistic.

12. The system of claim 9, wherein the determining the probability transient noise for the buffered subband frames comprises a model based Bayesian classifier including a Gaussian Mixture Model.

13. The system of claim 9, wherein the decomposing of the subband frames comprises performing a supervised multichannel blind demixing based on independent component analysis.

14. The system of claim 9, wherein the suppressing of the subband frames comprises performing a weighted Natural Gradient adaptation.

15. The system of claim 9, wherein each channel of the multichannel audio signal is provided by a microphone.

16. The system of claim 9, wherein the multichannel audio signal comprises static noise signals and target audio signals.

* * * * *